United States Patent [19]

Fuerst

[11] 3,936,979

[45] Feb. 10, 1976

[54] PARTICLE-RELEASING MOUNTING SYSTEM FOR THE BLADES OF BLASTING MACHINES

[75] Inventor: Bernard Fuerst, Grand Rapids, Mich.

[73] Assignee: Benfur Engineering Company, Grand Rapids, Mich.

[22] Filed: Oct. 10, 1974

[21] Appl. No.: 513,758

[52] U.S. Cl. ..... 51/9 R; 241/275

[51] Int. Cl.[2] ..... B24C 5/06

[58] Field of Search ..... 51/9 R, 9 M; 241/275, 300

[56] References Cited

UNITED STATES PATENTS

| | | | |
|---|---|---|---|
| 2,752,098 | 6/1956 | Adams | 241/275 X |
| 3,000,579 | 9/1961 | Bridgewater | 241/275 |
| 3,032,169 | 5/1962 | Bridgewater | 241/275 X |
| 3,436,867 | 4/1969 | Fuerst | 51/9 R |
| 3,474,974 | 10/1969 | Wood | 241/275 |
| 3,540,667 | 11/1970 | Parker | 241/275 |
| 3,606,182 | 9/1971 | Warren | 241/275 |

*Primary Examiner*—Donald G. Kelly
*Attorney, Agent, or Firm*—Glenn B. Morse

[57] ABSTRACT

The blades of a rotary blasting machine are removably mounted on a rotor bracket in a spaced relationship with the bracket outwardly from a point of contact at the inner extremity of the blade-bracket junction. Preferably, the space diverges outwardly, and an inner portion of the blade hooks over the bracket to resist centrifugal force acting on the blade, and also seal the junction against ingress of abrasive particles.

4 Claims, 12 Drawing Figures

PARTICLE-RELEASING MOUNTING SYSTEM FOR THE BLADES OF BLASTING MACHINES

BACKGROUND OF THE INVENTION

Rotary blasting machines have become standard equipment for processing metal surfaces to remove scale, and in preparation for the application of coatings of various types. In summary, these machines project a high velocity stream of abrasive particles at the target, the velocity being generated by a rotor shaped somewhat like a paddle wheel. The abrasive particles are fed into the central portion of the rotor at a selected point to establish a particular direction of the tangential stream emerging at the periphery of the rotor. These machines have evolved a fairly standard feeding mechanism that receives the bulk abrasive material, and distributes it at a uniform rate in to the area swept by a set of blades mounted on the rotor in a generally radial position with respect to the axis of rotation. These blades present flat or slightly curved surfaces close to a radial plane containing this axis of rotation, and these active surfaces of the blades are subject to violent erosion as the machine continues to operate. These conditions have resulted in the manufacture of these blades as replacable components of an extremely hard alloy. The need for frequent replacement, and the cost of the alloy material, have resulted in a strong need for a blademounting system that is secure enough to handle the centrifugal forces involved, and positive enough in placement of the blades to assure continuation of the most effective operating position.

A common type of rotor design uses a single plate mounted on a hub secured to a shaft rotating in conventional bearings, and adapted to receive power through a standard belt drive system. The plate is positioned in a plane perpendicular to the axis of rotation, and carries a set of brackets providing support for the blades. The blades have projections interengaging with these brackets to resist the action of centrifugal force, and a locking system is always incorporated to maintain the interengagement of the blades and the brackets. As thus broadly defined, such machines are conventional.

One of the problems involved in these machines is the tendency for abrasive particles to accumulate at the junction between the blades and the brackets, to the point that the position of the blade is distorted. This problem is dealt with in Application Ser. No. 465,550 (assigned to the same assignee as the present application), filed on Apr. 30, 1974, now U.S. Pat. No. 3,894,360, issued July 15, 1975, by shielding the inner extremity of the junction between the brackets and blades to at least protect this junction from the direct stream of abrasive particles. A substantial percentage of these particles, however, may be considered as moving in a random pattern at very high velocities, as a result of rebounding from the many surfaces on the rotor, blades, and feeding mechanism. This random movement has inevitably resulted in the eventual accumulation of particles between the blade and the bracket, although the shielding of the inner extremity has the effect of vastly reducing the rate of accumulation. It would be very desirable to not only further reduce this tendency, but eliminate it entirely.

Summary of the Invention

The present invention establishes a tendency for the particles finding their way into the junction between the blade and bracket to release, rather than accumulate. This is accomplished by establishing a spaced relationship between the blade and the bracket from a point outward of the inner extremity of the bracket. Preferably, the blade hooks over the bracket at this point to establish the sort of shielding action provided in Application Ser. No. 465,550, and additionally provides for the transfer of forces necessary to resist the centrifugal force operating on the blade. This produces a very solid interengagement between the blade and the bracket which functions additionally as a seal against the ingress of abrasive particles at this point. Any particles entering at the minute openings along the inevitably rough surfaces of the blade, or along the edges, are released because they then enter into a preferably diverging space between the blade and the bracket. The spaced relationship is established by projections preferably on the blade, which bear on the bracket near its outer extremity.

DESCRIPTION OF THE PREFERRED EMBODIMENT

Figure 1:
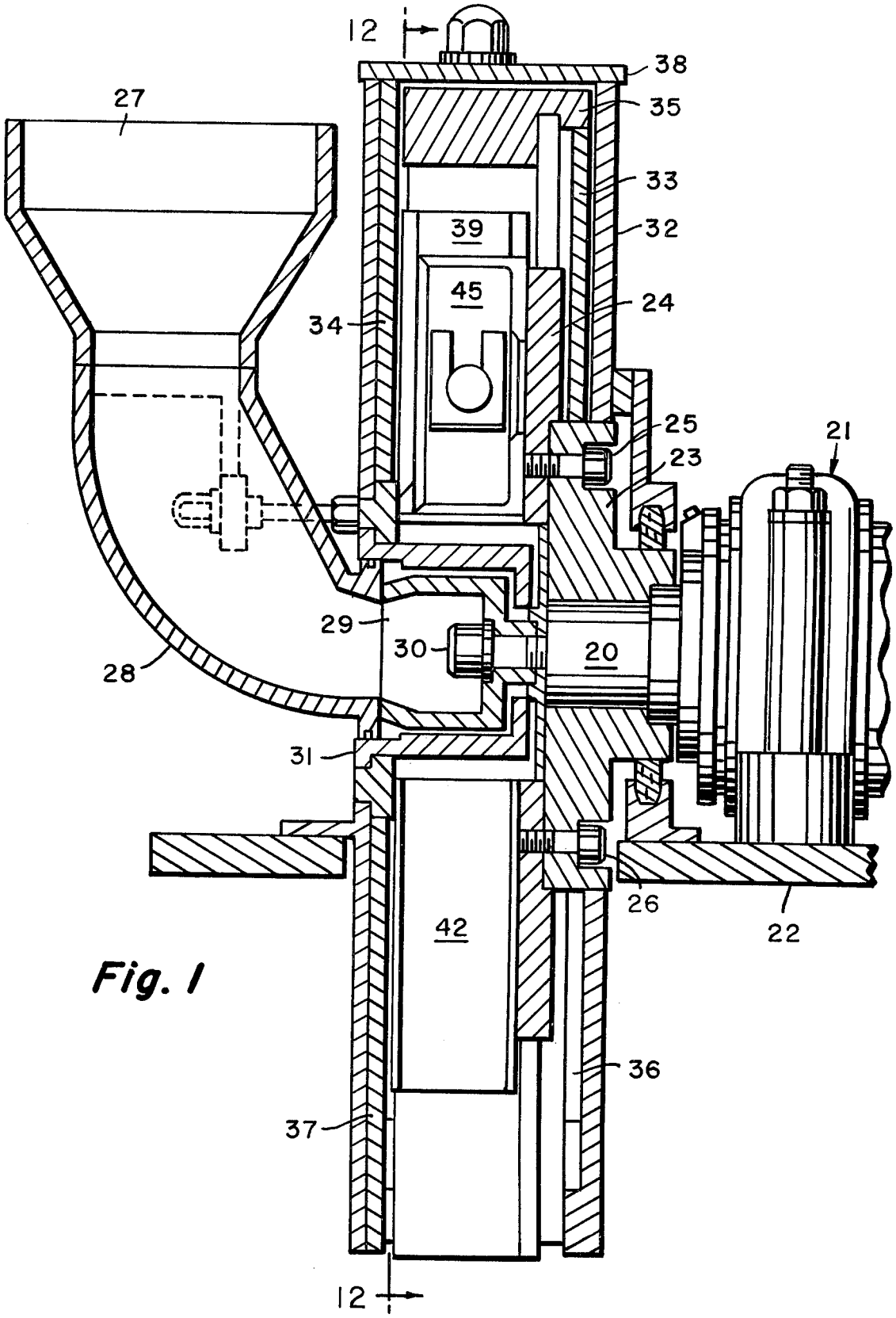
FIG. 1 is a sectional view of a blasting machine incorporating the present invention, taken on a plane containing the axis of rotation.
Figure 12:
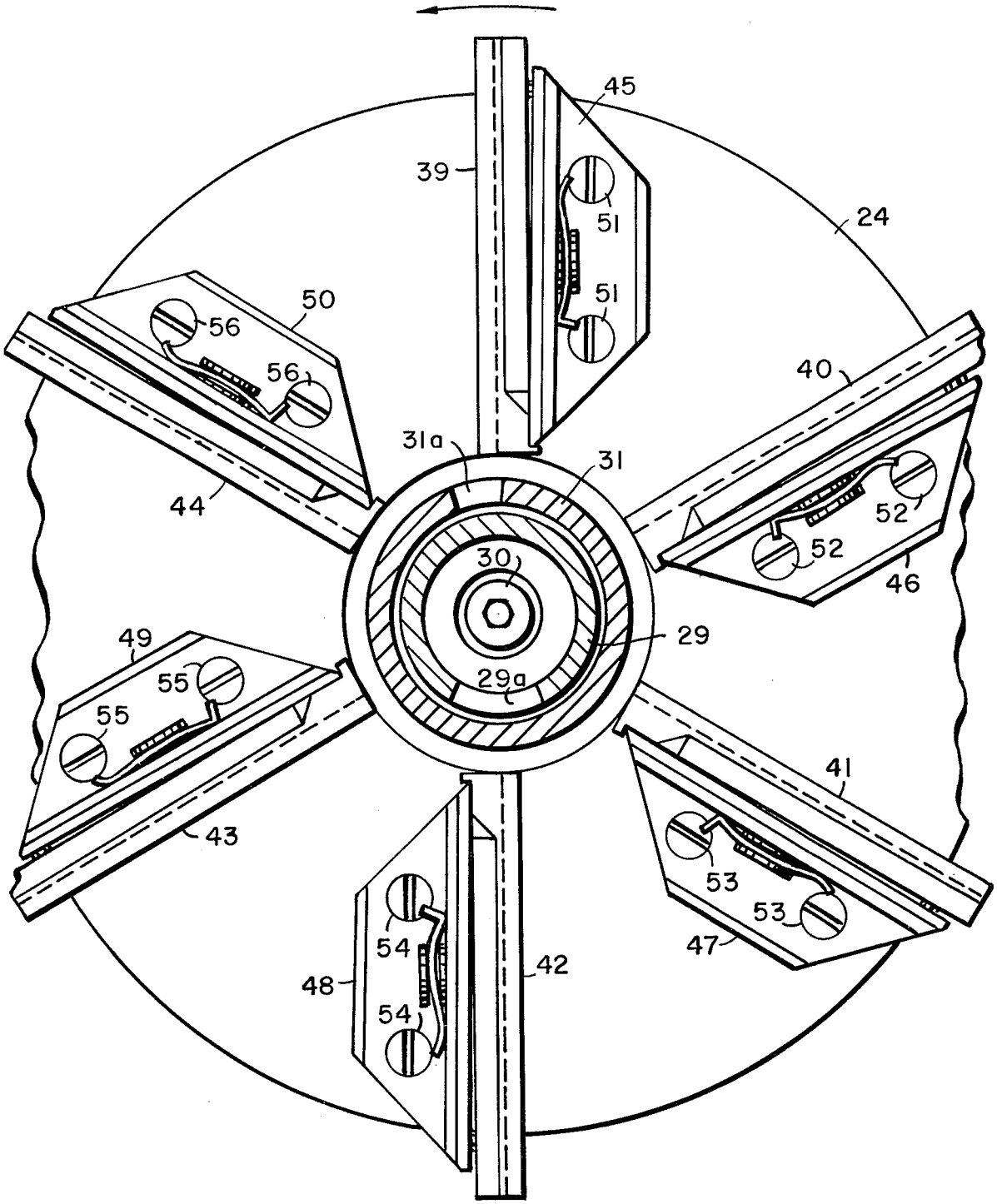
FIG. 12 is a view on a plane perpendicular to the axis of rotation, and illustrating the mounting of a group of blades and brackets on the rotor plate.

Referring to FIG. 1, the rotor shaft 20 is rotatably mounted in the conventional bearing assembly 21 mounted on the machine frame 22. A hub 23 is mounted on the shaft 20, and the rotor plate 24 is secured to the hub by a group of screws as indicated at 25 and 26 in FIG. 1. Bulk abrasive particles are deposited in the receptacle 27, and proceed through the elbow 28 into the space occupied by the impellor 29 secured to the shaft 20 with the bolt 30. The impellor thus rotates with the shaft, and distributes the abrasive particles through one or more perforations 29a in its peripheral wall into the interior of the adjustable control cage 31. (Refer to FIGS. 1 and 12.) This member usually has one peripheral opening 31*a*, and is rotatively adjustable with respect to the housing 32 so that this opening may be placed appropriately to produce a desired direction of tangential emergence of the abrasive particles at a selected target.

The housing is normally lined by a series of plates of very hard alloy, as indicated at 33–37, and has a removable cover 38 through which the liner member 35 can be removed for access to the interior of the machine for installation and removal of the blades 39–44. These blades are mounted on the brackets 45–50, respectively, secured to the rotor plate 24 by screws as shown at 51–56. These brackets are in a cross-sectional configuration presenting a right angle, with the flanges perpendicular to the plate 44 providing the supporting surfaces for the blades.

Figure 2:
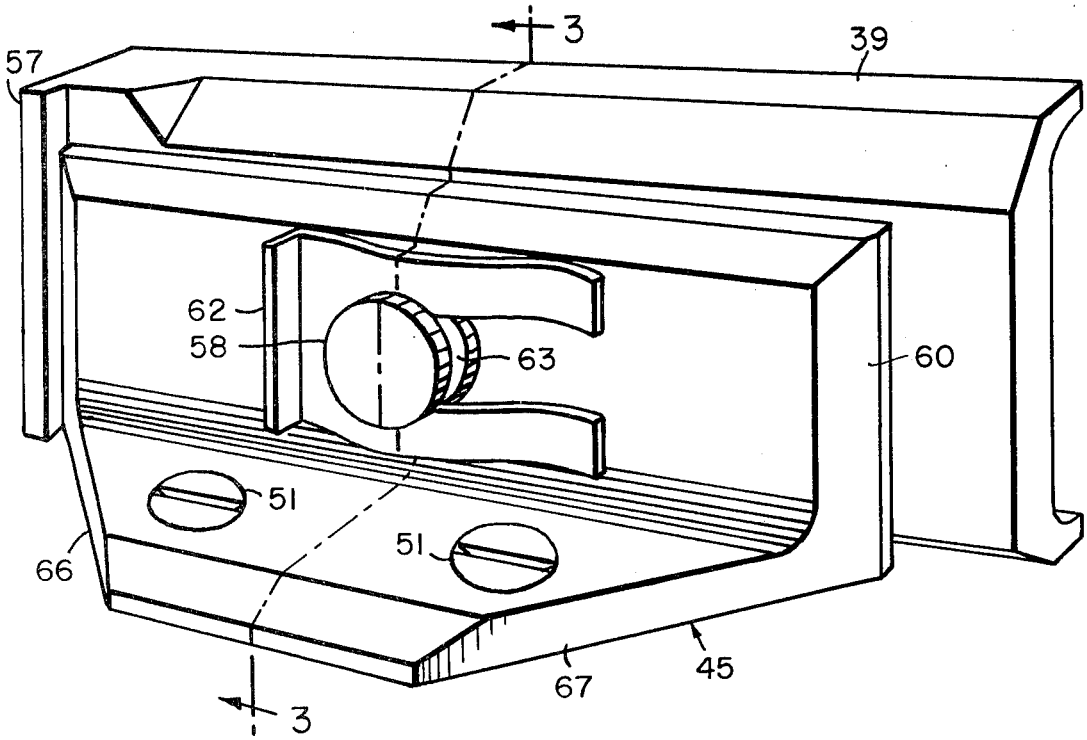
FIG. 2 is a perspective view showing a blade mounted on its support bracket.
Figure 3:
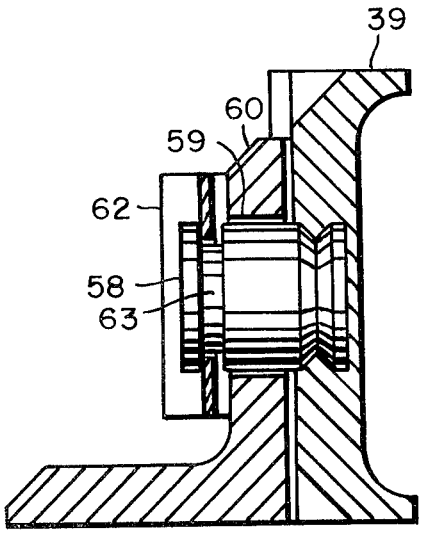
FIG. 3 is a sectional elevation on the plane 3—3 of FIG. 2.
Figure 4:
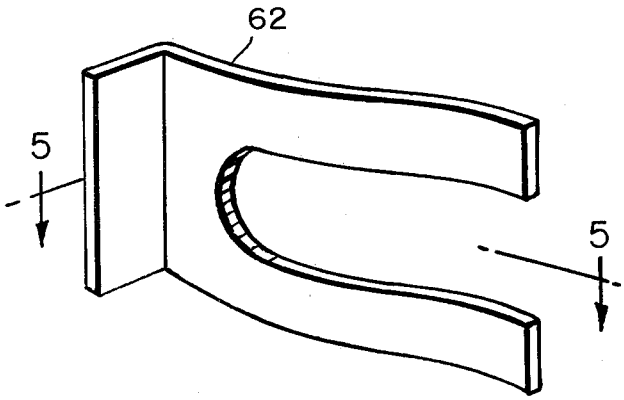
FIG. 4 is a perspective view of the locking clip used in the assembly appearing in FIG. 2.
Figure 5:
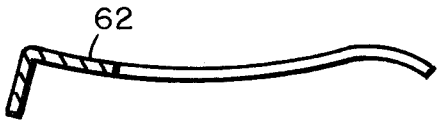
FIG. 5 is a section taken on the plane 5—5 of FIG. 4.
Figure 6:
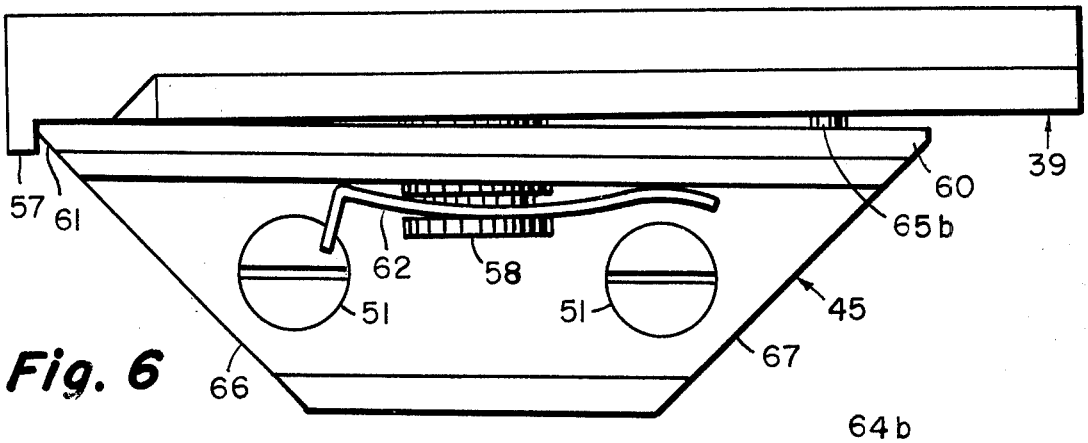
FIG. 6 is a top view of the assembly shown in FIG. 2.
Figure 7:
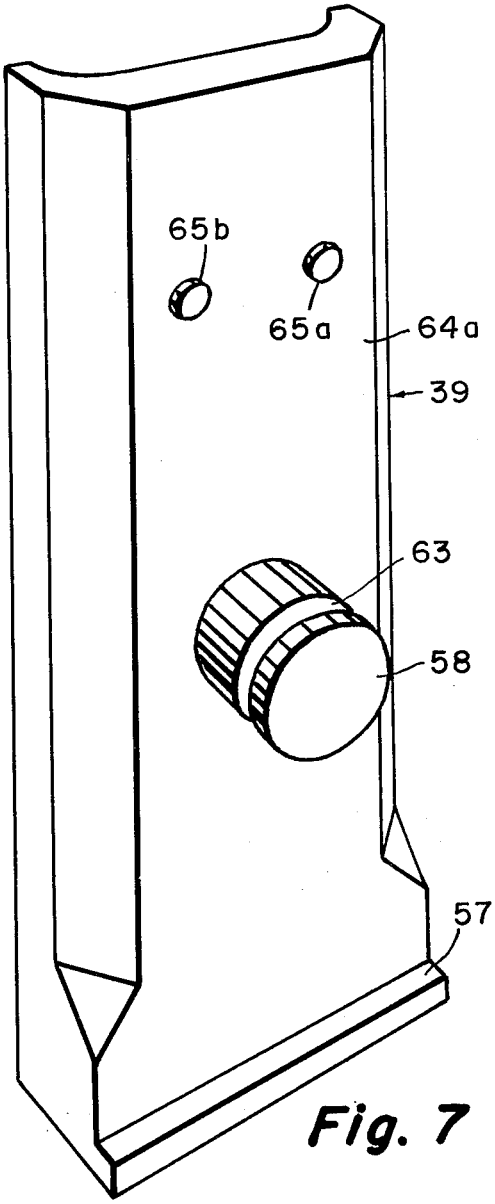
FIG. 7 is a perspective view showing the back of the blade.
Figure 8:
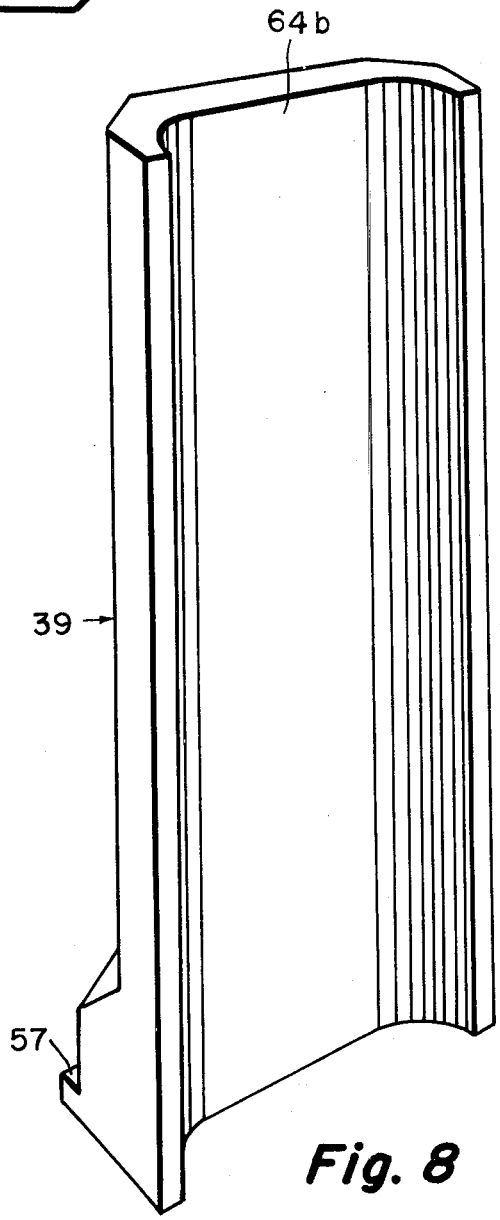
FIG. 8 is a perspective view showing the front, or throwing face, of the blade appearing in FIGS. 6 and 7.
Figure 9:
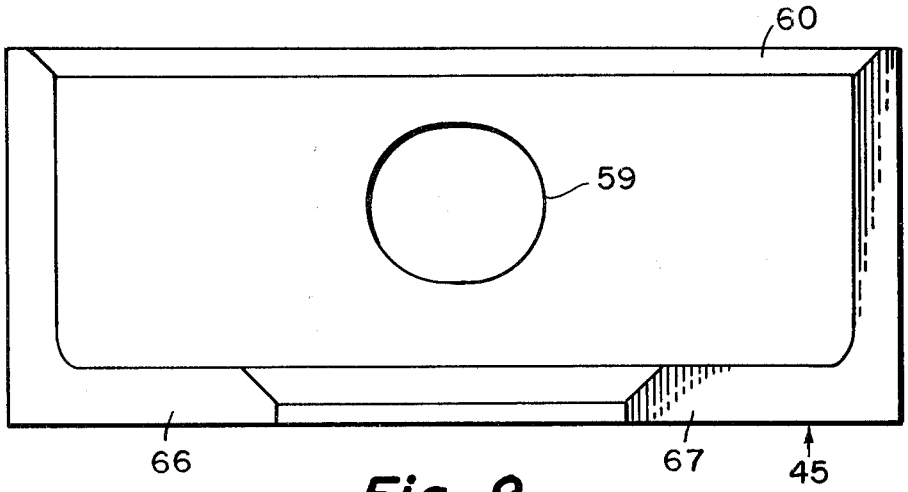
FIG. 9 is an elevation of the support bracket appearing in FIG. 6.
Figure 10:
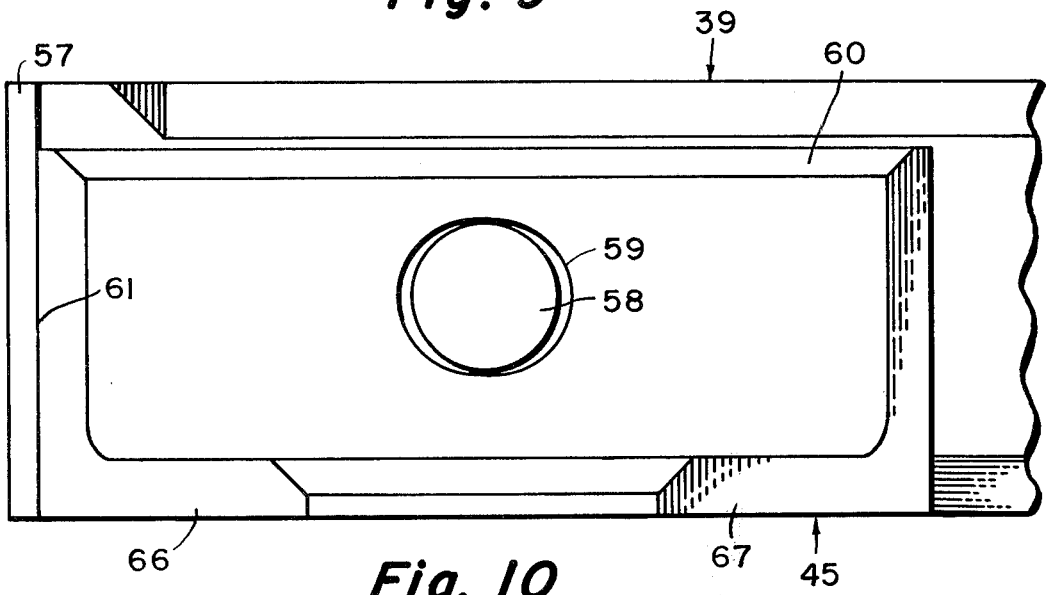
FIG. 10 illustrates the interengagement of the blade and bracket without the presence of the retaining clip.

The interengagement of the blades and brackets is shown in FIGS. 2 and 6, and in the views related to these figures. All of these mounted on the rotor are identical. An inner portion of the blade indicated at 57 hooks over the inner extremity of the bracket to provide a shield against the ingress of abrasive particles at this point, particularly those proceeding in the general stream moving outward through the rotor. This blade portion additionally forms a structural interconnection for the resistance of centrifugal force operating on the blade. To maintain the interengagement of the hooked inner portion 57 of the blades with the inner extremities of the brackets, the blades are provided with a projecting stud 58 normally traversing the opening 59 in the flange 60 of the brackets, which extends radially and generally parallel to the axis of rotation. This opening is elongated, as appears best in FIGS. 9–11, to assure that all of the centrifugal force is resisted by the interengagement of the inner blade portion 57 with the inner edge 61 of the bracket flange 60. This blade is held against the flange 60 by the resilient spring clip 62 engaging the groove 63 in the stud 58, as shown in FIG. 3. The effect of this clip is to function as a leaf spring, and resiliently hold the blade against the flange 60 of the bracket. The stud 58 is solidly secured to the material of the blade 39 as a result of being cast in place as an insert, according to conventional procedures.

Figure 11:
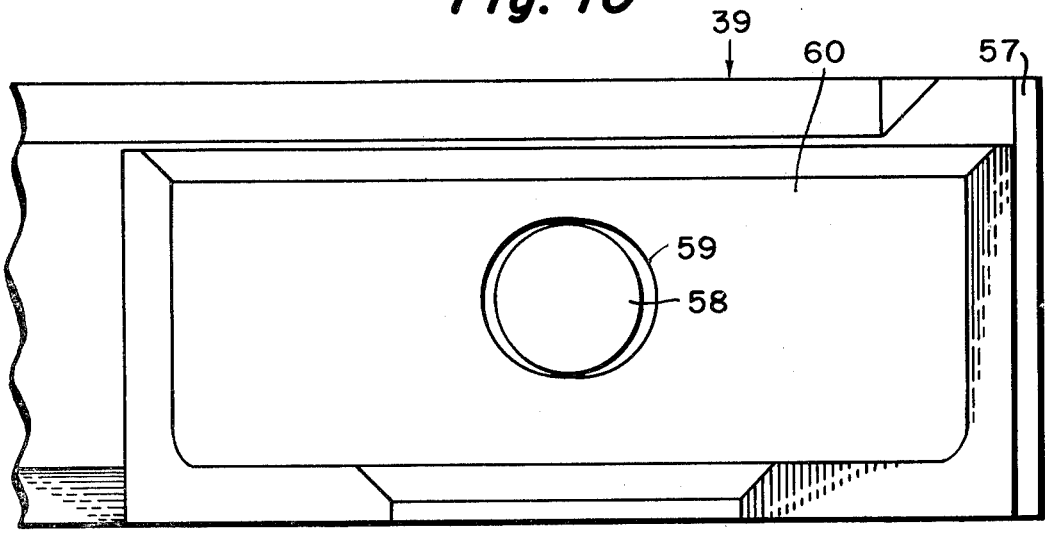
FIG. 11 shows an opposite-hand installation with respect to FIG. 10, corresponding to opposite rotation of a rotor assembly.

The back surface **64*a* of the blade is provided with projections as shown at 65*a* and 65*b*, which are cast integrally with the blade material. These are preferably on the order of 1/16th of an inch in height, and approximately ¼ of an inch in diameter, and establish a spaced relationship between the back surface 64*a* of the blade and the flange 60 of the bracket. Since the inner portion of the blade rests directly against this flange, the projections 65*a* and 65*b* establish a diverging space that has the effect of releasing any particles that find their way in between the blade and bracket. These could conceivably enter through minute gaps due to the surface irregularities in the blade material 39 at the junction between the portion 57 and the edge 61, or possibly as a result of rebounding from the sides of the liner plates so that they could enter laterally into the diverging space. In any case, the increasing gap will continually clear itself of any accumulation of particles that might otherwise build up under sufficient pressure to lift the blade against the action of the spring clip 62, and distort its operating position, and possibly disengage the portion 57. This position is selected as a result of experience to place the throwing face 64*b* at a particular orientation with respect to the axis of rotation to produce the best results with respect to both the direction and nature of the stream of abrasive, and to establish the best wearing characteristics. To minimize the effects of wear on the brackets, and also to reduce interference between the brackets and the following blades, the base flanges of the brackets are beveled as shown at 66 and 67. The double bevel permits the brackets to be used on wheels of rotor assemblies adapted for either direction of rotation. FIG. 11 illustrates a mounting for the direction of rotation opposite from that of FIG. 10**. Except for this right-left hand relationship, the structure in both cases is identical.

I claim:

1. A blasting machine having a rotor including a rotatable shaft and a plate mounted on said shaft in a plane normal to the axis of rotation of said shaft, and also including at least one bracket secured to said plate and a blade detachably secured to said bracket in a position adjacent a radial plane containing said axis, said machine also including feeding means adapted to supply abrasive material to the central portion of said rotor for engagement with said blade, wherein the improvement comprises:

projection means on at least one of said bracket and said blade extending from the face of said one of said bracket and blade opposite the other thereof and establishing a space between said opposite faces.

2. A machine as defined in claim 1, wherein said space diverges radially outward.

3. A machine as defined in claim 1, wherein said blade has a portion overhanging the inner extremity of the junction between said blade and bracket as a shield for said junction against the entrance of abrasive particles.

4. A machine as defined in claim 3, wherein said portion and bracket interengage to resist the centrifugal forces normally acting on said blade.

* * * * *